US005531658A

United States Patent [19]

L. S. C.

[11] Patent Number: 5,531,658

[45] Date of Patent: Jul. 2, 1996

[54] EXERCISE DEVICE FOR BUILDING AND REHABILITATING WAIST

[76] Inventor: Liao L. S. C., No. 264, Sec. 2, Shi-Tung Rd., Taichung, Taiwan

[21] Appl. No.: 544,585

[22] Filed: Oct. 18, 1995

[51] Int. Cl.[6] ..... A63B 26/00; A61H 1/00

[52] U.S. Cl. ..... 482/142; 601/90; 482/96; 482/90

[58] Field of Search ..... 601/97, 84, 98, 601/89, 90, 100; 606/242, 237, 241, 245; 482/90, 142, 96, 97

[56] References Cited

U.S. PATENT DOCUMENTS

| | | | |
|---|---|---|---|
| 2,448,777 | 9/1948 | Crise | 601/90 |
| 3,075,518 | 1/1963 | Sellner | 601/24 |
| 4,958,627 | 9/1990 | Park | 601/49 |
| 5,443,439 | 8/1995 | Ohshita | 601/90 |

FOREIGN PATENT DOCUMENTS

| | | | |
|---|---|---|---|
| 1600769 | 10/1990 | U.S.S.R. | 601/51 |

*Primary Examiner*—Jerome Donnelly
*Attorney, Agent, or Firm*—Browdy and Neimark

[57] ABSTRACT

A waist building device comprises a frame, two urging members, a shaft, a flexible piece, a linking mechanism, two pull rods, and two connection rods. The urging members are mounted respectively at both ends of the upper side of the frame. The shaft is slidably received in a shaft hole of the frame. The flexible piece is fastened with the shaft such that both ends of the flexible piece are urged respectively by the urging members. The linking mechanism is located at the bottom of the frame such that the linking mechanism is interchangeable between a horizontal motion and a vertical motion, and that the linking mechanism is connected with the shaft. Two pull rods are fastened pivotally at the bottom ends thereof with both ends of the bottom of the frame. Two connection rods are fastened with the pull rods and the linking mechanism for causing two pull rods to actuate the linking mechanism which in turn actuates the shaft to slide up and down.

6 Claims, 4 Drawing Sheets

EXERCISE DEVICE FOR BUILDING AND REHABILITATING WAIST

FIELD OF THE INVENTION

The present invention relates generally to an exercise machine, and more particularly to an exercise machine for building and the rehabilitating waist.

BACKGROUND OF THE INVENTION

There are a variety of indoor exercise devices for simulating the rowing, the jogging, the cliff climbing, the horse riding, etc. Such conventional exercise devices as mentioned above are not intended specifically for building the waist of an exerciser.

SUMMARY OF THE INVENTION

It is therefore the primary objective of the present invention to provide an exercise device which is designed specifically for use in building and rehabilitating a person's waist.

The foregoing objective of the present invention is attained by the exercise device, which comprises a frame, two urging members, a shaft, a flexible piece, a linking mechanism, two pull rods, and two connection rods. Two urging members are mounted respectively at both ends of the upper side of the frame. The shaft is slidably received in a shaft hole of the frame. The flexible piece is fastened with the shaft such that both ends of the flexible piece are urged respectively by the urging members. The linking mechanism is located at the bottom of the frame such that the linking mechanism is interchangeable between a horizontal motion and a vertical motion, and that the linking mechanism is connected with the shaft. Two pull rods are fastened pivotally at the bottom ends thereof with both ends of the bottom of the frame. Two connection rods are fastened with the pull rods and the linking mechanism for causing two pull rods to actuate the linking mechanism which in turn actuates the shaft to slide up and down.

The foregoing objective, features, functions and advantages of the present invention will be more readily understood upon a thoughtful deliberation of the following detailed description of an embodiment of the present invention in conjunction with the accompanying drawings.

DETAILED DESCRIPTION OF THE INVENTION

Figure 1:
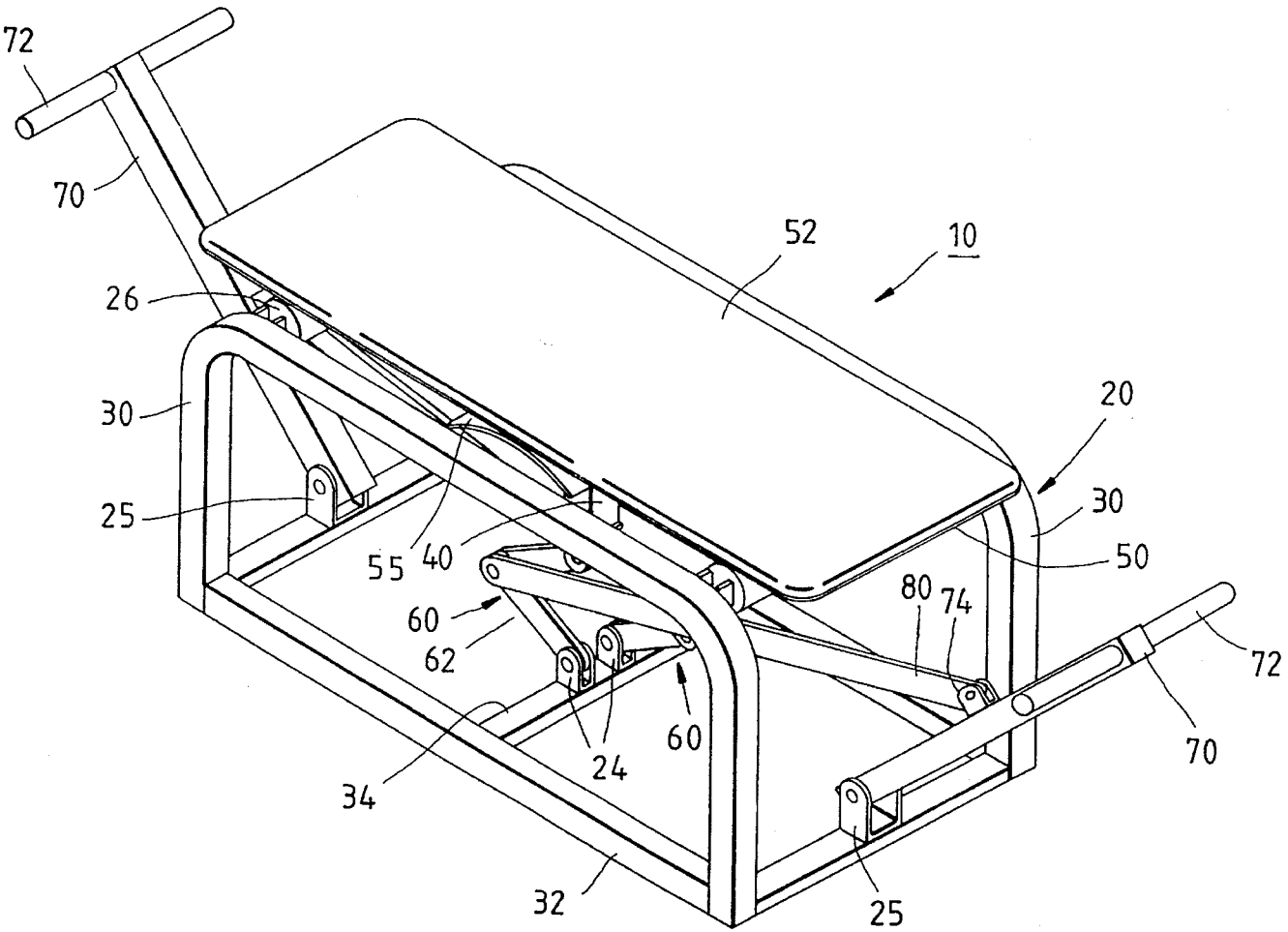
FIG. 1 shows a perspective view of the embodiment of the present invention.
Figure 2:
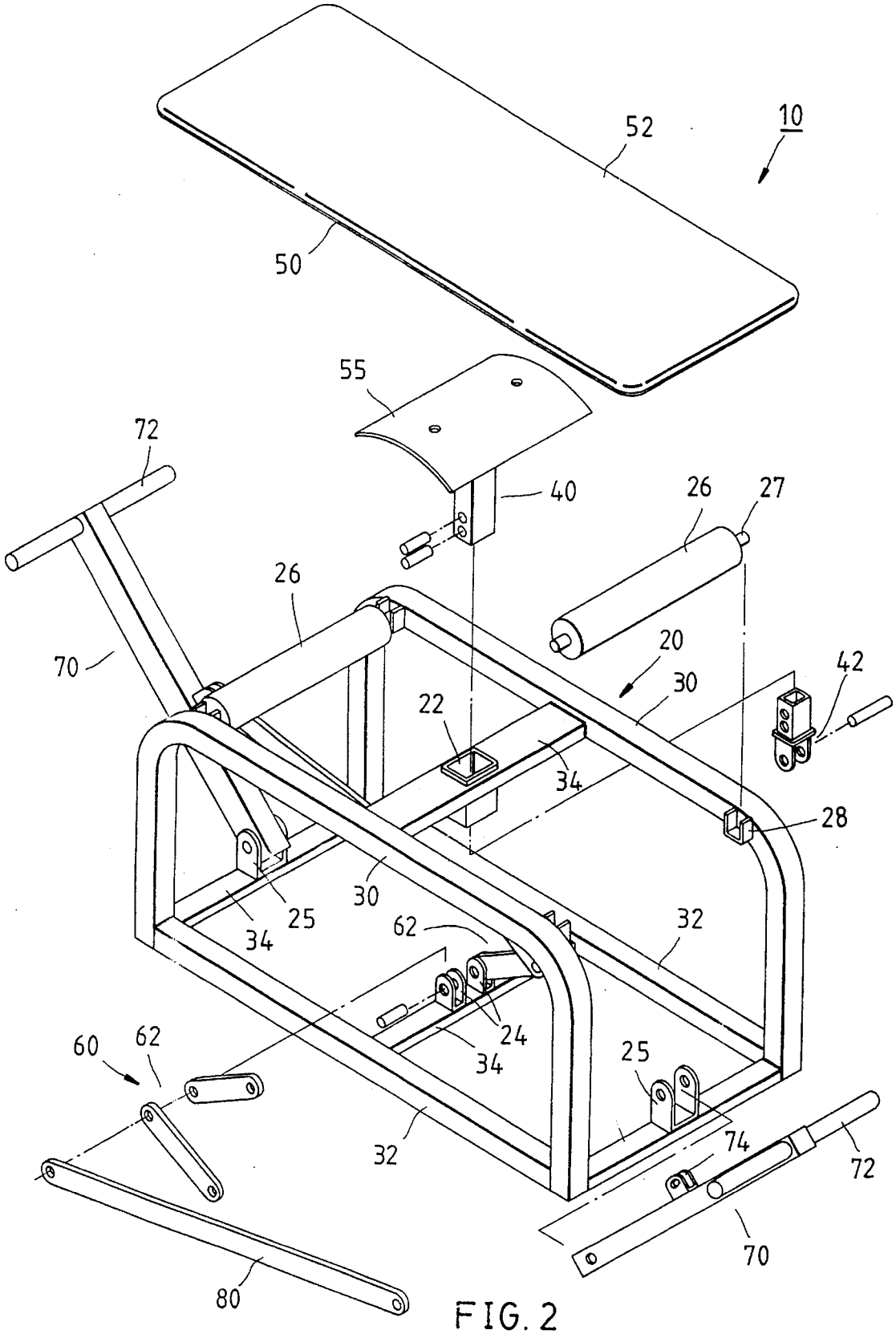
FIG. 2 shows an exploded view of the embodiment as shown in FIG. 1.

As shown in FIGS. 1 and 2, a waist building device 10 embodied in the present invention is composed of the component parts, which are described explicitly hereinafter.

A frame 20 has a predetermined dimension and is provided centrally in the upper side thereof with a shaft hole 22. The frame 20 is further provided at the bottom thereof with pivoting portions 24 and 25, which are of a luglike construction. Two urging members are preferably two rollers 26 which are provided respectively with a center shaft 27 which is fastened pivotally and respectively at both ends thereof with the frame 20 by means of a fixation member 28. The rollers 26 are mounted respectively at both ends of the upper side of the frame 20. The frame 20 comprises mainly two main supports 30, two bottom supports 32, and a plurality of cross rods 34. The main supports 30 are of an inverted U-shaped construction and are parallel to each other. Each of two bottom supports 32 is fastened at both ends thereof with the main support 30. The cross rods 34 are fastened between two main supports 30 and two bottom supports 32. The shaft hole 22 and the pivoting portions 24 and 25 are located respectively on the cross rods 34.

A shaft 40 is received in the shaft hole 22 of the frame 20 such that the shaft 40 can be caused to slide up and down along the direction of the axis of the shaft hole 22. The shaft 40 is provided at the bottom end thereof with a pivoting portion 42 of a luglike construction.

A flexible piece 50 is preferably made of a steel material and is slightly longer than the frame 20. The flexible piece 50 is provided on the upper surface thereof with a cushioning layer 52 of a soft material, which is attached thereto. The flexible piece 50 is fastened at the center of the underside thereof with an arcuate rigid plate 55 which is fastened with the top end of the shaft 40. Both ends of the flexible piece 50 is rested on two rollers 26.

A linking mechanism 60 is composed of two cranks 62 which are arranged symmetrically at the center of the bottom of the frame 20. In other words, the cranks 62 are located right under the shaft 40 such that the cranks 62 are fastened pivotally at the bottom ends thereof with the pivoting portion 24 which is fastened with the cross rod 34 of the frame 20, and that the cranks 62 are fastened pivotally at the top ends thereof with the pivoting portion 42 which is located at the bottom of the shaft 40. The cranks 62 serve to change a horizontal motion to a vertical motion. The horizontal motion takes place in the direction of the longitudinal axis of the frame 20.

Two pull rods 70 are provided respectively at the top end thereof with a foot rest 72 and are further provided respectively with a pivoting portion 74. These two pull rods 70 are fastened pivotally and respectively at the bottom end thereof with the pivoting portion 25 of the frame 20.

Two connection rods 80 are fastened pivotally and respectively at one end thereof with the pivoting portion 74 of the pull rod 70 and are further fastened pivotally and respectively at another end thereof with the crank 62 of the linking mechanism 60 so as to enable the pull rods 70 to actuate the linking mechanism 60.

Figure 4:
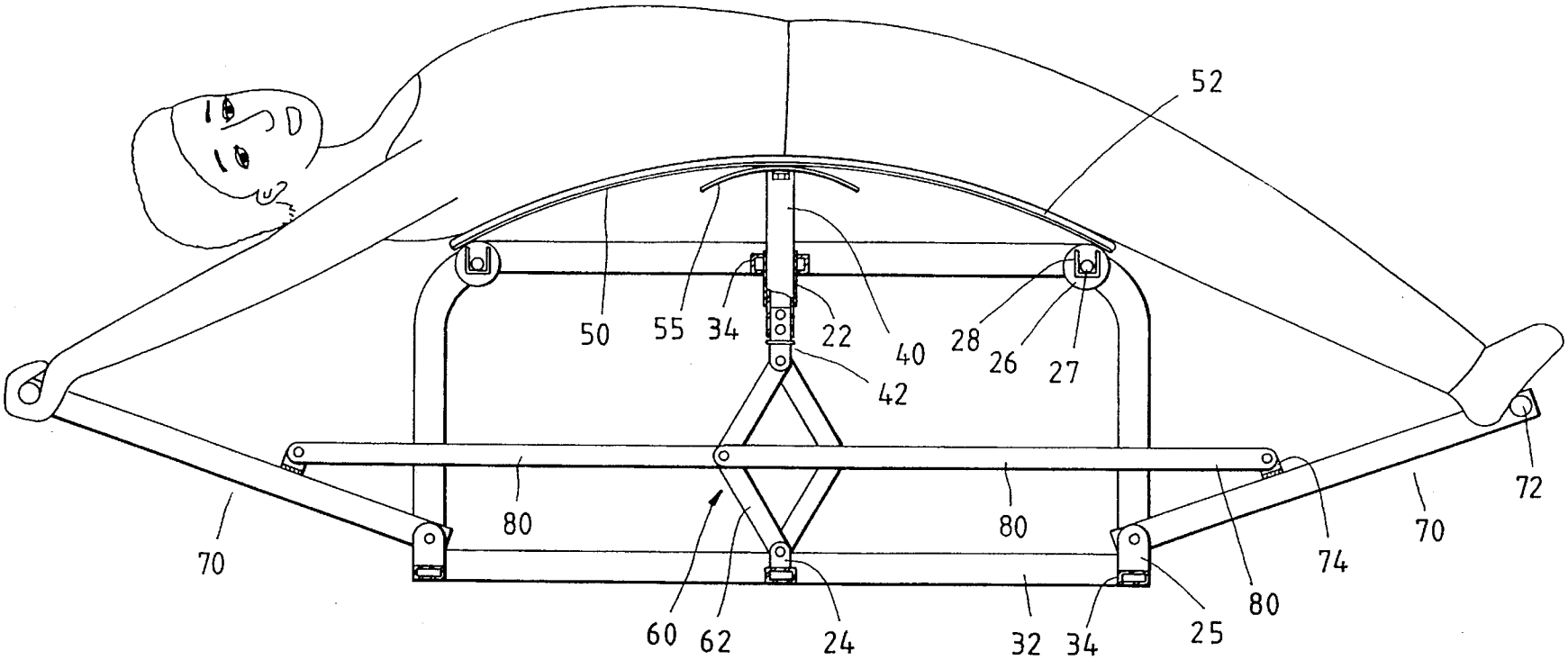
FIG. 4 shows another side view of the embodiment of the present invention at work.

In operation, an exerciser lies on the flexible piece 50 such that his or her waist is corresponding in location to the shaft 40, and that his or her hands hold the foot rest 72 of one pull rod 70, and further that his or her feet rest on the foot rest 72 of another pull rod 70. Two pull rods 70 are then pushed outwards by both hands and both feet of the exerciser lying on the flexible piece 50. As a result, two connection rods 80 are actuated to trigger the linking mechanism 60 to bring about a horizontal motion. The horizontal motion is changed to the vertical motion by the linking mechanism 60. The shaft 40 is caused to move upwards in the shaft hole 22 so as to raise the flexible piece 50, as shown in FIG. 4. As two pull rods 70 are further pushed outwards, the shaft 40 is caused to move upwards further. The body of the exerciser lying on the flexible piece 50 is therefore bent, as shown in FIG. 4. When the exercise described above is under way, two rollers 26 supporting both ends of the flexible piece 50 are caused to move.

Figure 3:
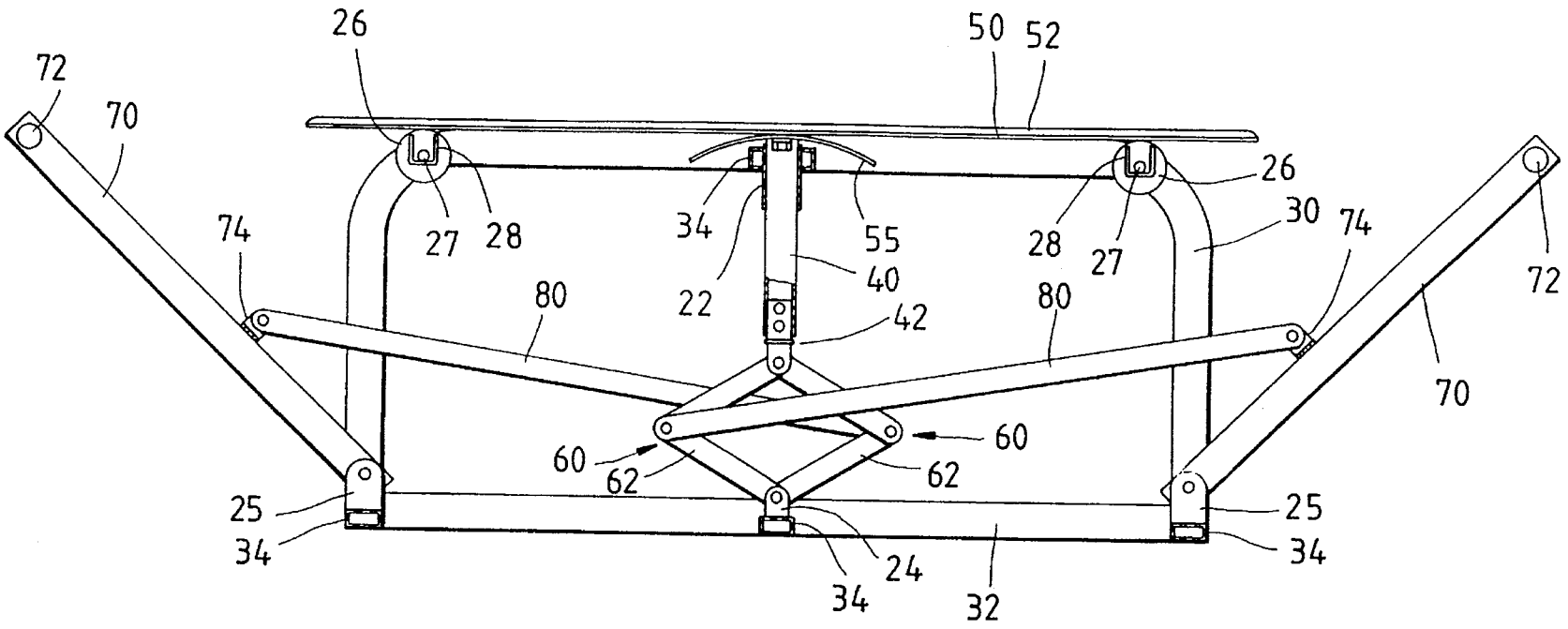
FIG. 3 shows a side view of the embodiment of the present invention at work.

As the pull rods 70 are relieved of the pressure exerting thereon, the shaft 40 is caused to move downwards in the shaft hole 22 by the weight of the exerciser, thereby causing the linking mechanism 60 to change the vertical motion to the horizontal motion. As a result, the pull rods 70 are actuated by the connection rods 80 to swivel back to their initial positions, as shown in FIG. 3.

The embodiment of the present invention described above is to be regarded in all respects as merely illustrative and not restrictive. Accordingly, the present invention may be embodied in other specific forms without deviating from the spirit thereof. The present invention is therefore to be limited only by the scopes of the following appended claims.

What is claimed is:

1. A waist building device, which comprises:

a frame provided centrally with a shaft hole and further provided respectively at both ends of a longitudinal axis thereof with an urging member;

a shaft slidably received in said shaft hole of said frame;

a flexible piece fastened at a center of an underside thereof with a top end of said shaft such that both ends of a longitudinal axis of said flexible piece are urged respectively by said urging member 5;

a linking mechanism disposed at a bottom portion of said frame to change a horizontal motion to a vertical motion and vice versa, said linking mechanism being connected with said shaft which is actuated by said linking mechanism to move in said shaft hole at the time when said linking mechanism is exerted on by an external force;

two pull rods provided respectively with a foot rest and fastened pivotally and respectively with both ends of said frame along the longitudinal axis of said frame; and two connection rods each having a first and second end said first and second end respectively pivotally connected to a pull rod of said pull rods, and said linking mechanism wherein an exerciser lies on said flexible piece such that his or her waist is corresponding in location to the shaft and that his or her hands hold the foot rest, of the pull rod, and further that his or her feet rest on the foot rest of the other of said pull rod, and said pull rods are then push outward by both hands and both feet of the exerciser lying on the flexible piece, the two connecting rods are actuated to trigger the linking mechanism to bring about a vertical motion of the shaft so as to raise the flexible piece against the waist of the user.

2. The waist building device as defined in claim 1, wherein said linking mechanism comprises two cranks fastened pivotally and respectively at one end thereof with said frame and at another end thereof with said shaft.

3. The waist building device as defined in claim 1, wherein said horizontal motion is along the direction of said longitudinal axis of said frame.

4. The waist building device as defined in claim 1 further comprising an arcuate rigid plate located between said flexible piece and said shaft.

5. The waist building device as defined in claim 1, wherein said frame comprises two main supports of an inverted U-shaped construction and parallel to each other, two bottom supports fastened with said two main supports, and a plurality of cross rods fastened between said two main supports and said two bottom supports.

6. The waist building device as defined in claim 1, wherein said flexible piece is provided on an upper surface thereof with a cushioning layer of a soft material.

* * * * *